US007442678B2

(12) United States Patent
Sandbach et al.

(10) Patent No.: US 7,442,678 B2
(45) Date of Patent: Oct. 28, 2008

(54) STAIN REMOVAL METHOD UTILIZING A COMPOSITION COMPRISING HYDROGEN PEROXIDE AND CYCLODEXTRIN

(75) Inventors: David Roy Sandbach, Hexham (GB); Jean Wevers, Steenhuffel (BE); Gautier Engisch, Uccle (BE)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 11/264,863

(22) Filed: Nov. 2, 2005

(65) Prior Publication Data

US 2006/0053567 A1 Mar. 16, 2006

Related U.S. Application Data

(63) Continuation of application No. 10/041,171, filed on Jan. 8, 2002, now abandoned, which is a continuation of application No. PCT/US00/18915, filed on Jul. 11, 2000.

(51) Int. Cl.
*C11D 3/395* (2006.01)
*C11D 3/22* (2006.01)
*C11D 3/44* (2006.01)

(52) U.S. Cl. ..... 510/283; 510/276; 510/281; 510/282; 510/286; 510/293; 510/302; 510/309; 510/342; 510/372; 510/375; 510/432

(58) Field of Classification Search ..... 510/276, 510/281, 282, 283, 286, 293, 302, 309, 342, 510/372, 375, 432
See application file for complete search history.

(56) References Cited

U.S. PATENT DOCUMENTS

| | | | | |
|---|---|---|---|---|
| 5,840,675 | A * | 11/1998 | Yeazell | 510/417 |
| 5,872,090 | A * | 2/1999 | You et al. | 510/284 |
| 6,233,771 | B1 * | 5/2001 | Hortel et al. | 8/150 |
| 6,376,444 | B1 * | 4/2002 | Hortel et al. | 510/277 |
| 6,436,342 | B1 * | 8/2002 | Petri et al. | 422/28 |
| 6,613,733 | B1 * | 9/2003 | Barnabas et al. | 510/470 |
| 6,893,469 | B1 * | 5/2005 | Van Hauwermeiren et al. | 8/149.1 |
| 2003/0087781 | A1 * | 5/2003 | Van Hauwermeiren et al. | 510/214 |

FOREIGN PATENT DOCUMENTS

WO 98/20735 * 5/1998

* cited by examiner

*Primary Examiner*—Charles I Boyer
(74) *Attorney, Agent, or Firm*—Armina E. Matthews; Kim William Zerby; Steven W. Miller

(57) ABSTRACT

The present invention relates to an applicator for a fabric treatment composition and its application. More specifically the invention relates to a versatile, effective convenient to apply fabric treatment applicator and its method of application. Claimed and described is method for the application of a fabric treatment composition, which comprises bleach and which is left to evaporate after being applied to a fabric.

13 Claims, No Drawings

STAIN REMOVAL METHOD UTILIZING A COMPOSITION COMPRISING HYDROGEN PEROXIDE AND CYCLODEXTRIN

CROSS REFERENCE TO RELATED PATENT APPLICATIONS

This application is a continuation application of U.S. patent application Ser. No. 10/041,17 1, filed Jan. 8, 2002 which is a continuation application of prior copending International Application Serial No. PCT/US00/18915, filed Jul. 11, 2000, designating the U.S., the disclosures of which are all incorporated by reference herein.

FIELD OF THE INVENTION

The present invention relates to an applicator for a fabric treatment composition and its application. More specifically the invention relates to a convenient to carry fabric treatment applicator comprising a bleach and to an optimal method for its application.

BACKGROUND OF THE INVENTION

Portable stain removers for pre laundry application, post laundry application or application on fresh stains, also in forms of applicators for a liquid composition, are known articles of manufacture. Similarly, portable applicators for the application of other liquid compositions are known, for example in the field of ink removal. Prior art in this field includes the following documents:

U.S. Pat. No. 5,288,420 discloses a stain removal composition provided in form of a solid stick, which can be applied to selected areas of a fabric in laundry preparations. Various compositions are disclosed comprising surfactants, enzymes and glycols. U.S. Pat. No. 3,748,268 discloses a stain removal composition especially for carpets and upholstery comprising surfactant for an aerosol formulation. EP 0 205 999 discloses the provision of a laundry preparation composition in the form of a solid stick. WO 85/00782 discloses a kit comprising coloured fluids and an eradicator for these fluids, which can be used on various materials including clothing. DE 2422191 discloses a solution to be used on stains provided in an applicator with a felt insert. DE 19536714 discloses an applicator for a stain removal fluid which takes the form of a pen. WO 99/02769 discloses an impregnated towelette to clean stains from clothes and upholstery, comprising surfactant.

None of the above fabric treatment compositions comprises bleach. Moreover, these patents do not give details of how the various applicators should be used.

Applicators comprising bleach are known in other fields than fabric treatment: U.S. Pat. No. 5,324,131 discloses an applicator for a liquid bleaching agent to be used to eradicate or remove an emphasising ink. The applicator may be provided with a felt tip or roller. U.S. Pat. No. 5,611,687 discloses an oral fluid, e.g. for the teeth or the gum, and an applicator for it comprising a broad fibre tip or a roller ball.

Prior art documents which address the application of the respective compositions with some detail include the following documents:

U.S. Pat. No. 5,122,158 discloses an applicator for an enzyme-containing liquid detergent for the application in laundry preparation. The applicator comprises a porous body made of a synthetic plastic material. The heat resulting from the friction produced by the applicator during application to a fabric is assumed to contribute to a more rapid enzymatic reaction.

WO 97/20099 discloses an applicator for the post-laundry treatment of fabrics. A two step process is taught which involves the use of an iron on one side of the fabric and the use of an absorbent layer on the other side of the fabric.

U.S. Pat. No. 5,872,090 discloses a stamp like applicator for a fabric treatment composition comprising bleach and surfactant, which is to be applied to a fabric in a rocking motion. The treatment is preferably followed by a post treatment process in a hot air cloth/tumble dryer. A rubbing action as opposed to a rocking action is expressly taught to be of disadvantage as to minimise fabric damage.

The Helmac Stain Eraser, as marketed on the internet by the Helmac Products Corporation, incorporates a plastic tip for rubbing. The device according to the usage instructions is not recommended for use on silk, suede or leather. A stain removal treatment with this device further requires a post-treatment step of removing the stain or residues of the fabric treatment liquid by rinsing the stain away with water or blotting with a moist cloth.

The prior art however has still not provided a fabric treatment method which is highly convenient and effective and which can be utilised when not at home. In contrast, the present method is immediately applicable, for example, to fresh stains on a fabric as they may occur at work, in a restaurant, when traveling, etc. While WO 97/20099 and U.S. Pat. No. 5,872,090 both teach efficient stain removal methods, these methods appear to be primarily suitable for use at home. Use of the Helmac stain eraser involves the inconvenience of undertaking a post treatment step. In another aspect the present method is optimized so as to leaving no residues on a fabric, since the comprised bleach has surprisingly been found to be an effective fabric treatment component which leaves particular low and typically no visible residues.

Hence, it is an objective of the present invention to afford a convenient fabric treatment immediately applicable to fresh stains.

It is a further objective of the present invention to provide a method applicable in many situations, namely when not at home.

It is yet a further objective of the present invention to provide a fabric treatment method which allows a single step application.

It is still a further objective of the present invention to provide a method which does not leave any visible residues on a treated fabric.

It is yet a further objective of the present invention to provide a fabric treatment method which is easy to apply.

It is an additional objective of the present invention to provide a fabric treatment method which can be successfully used on a large variety of stains and fabrics.

These and other objectives as apparent from the following description are addressed by the present invention.

SUMMARY OF THE INVENTION

The present invention relates to an applicator for a fabric treatment composition and its application. More specifically the invention relates to a versatile, effective convenient to apply fabric treatment applicator and its method of application. Claimed and described is method for the application of a fabric treatment composition, which comprises bleach and which is left to evaporate after being applied to a fabric.

DETAILED DESCRIPTION OF THE INVENTION

The present invention affords a convenient, residue-free fabric treatment by treating a fabric with a composition comprising bleach and allowing the composition on the treated fabric to evaporate. The fabric treatment method according to the present invention involves the use of an fabric treatment applicator comprising a fabric treatment composition. Both are described in detail hereinafter.

Methods of Application

The use of any applicator with any composition disclosed herein will depend on the applicator itself and also on the object on which the applicator is to be used.

The compositions disclosed herein are particularly applicable on fabric. The term fabric as used herein inter alia encompasses all materials used for clothing, namely textile fabrics, leather, suede and all artificial fabrics, such as artificial leather. Textile fabrics namely are found in clothing, including shirts, ties, blouses, socks, skirts, trousers, jackets, underwear, watch straps etc.

Moreover these compositions can also be used on fabrics comprised by carpets, curtains or upholstery and the like.

For a fabric treatment applicator comprising a housing and an application device a cap covering the application device, if present, is removed before application. The application device is then brought in contact with a selected area of an object. For some application devices exertion of pressure may be needed to release the composition from the applicator. The pressure initially needed for this purpose may be higher than the pressure needed to keep up the flow of composition. Wiping or otherwise moving the application device over the selected application area may be required to deliver the composition to all parts of this area and may help to uniformly apply the composition. Rubbing, i.e. wiping while exerting pressure towards the object, may help in the mechanical removal of stains.

The application of any composition disclosed herein, may be one step of a more comprehensive treatment of an object, namely a fabric. The treatment may for example comprise preparing steps, such as removing larger amounts of a stain inducing material, e.g. food, with a serviette or the like.

According to the present invention the fabric after application of the fabric treatment composition is left to evaporate. "Left to evaporate", as used herein, means that the treated fabric, typically a garment comprising the treated fabric is either worn or maintained in some fashion, for example stored in a wardrobe, at ambient temperature. Applying heat specifically to the treated fabric, for example by a hair dyer, an iron or in a tumble dryer, is not encompassed by the term "left to evaporate". Preferably the fabric after treatment is left to evaporate for 10 hours to 30 seconds, more preferably 2 hours to 1 minute, yet more preferably 1 hour to 5 minutes, most preferably 30 minutes to 10 minutes.

Ambient temperature as used herein refers to any temperature of any space were people wearing garments are normally present or fabric is normally stored, may it be inside or outside of any building. For example ambient temperature may refer to outside air temperature or to room temperature.

A fabric is herein referred to as "worn" if it is comprised by a garment which is worn by a person. Such a garment may have direct contact with the body of the wearing person, e.g. as typically the case for underwear, or indirect contact with the body of the wearing person, as for example a coat, which is typically worn over other garments.

Hence, a stain removal treatment carried out according to the present invention does not require comprehensive post-treatment steps, such as a rinsing or drying step. Such steps are not required, since the compositions disclosed herein are highly efficient in removing any stains, including water soluble ones. Moreover, post-treatment of a fabric under running water or with a moist cloth is not required—neither as not to lease residues nor for mechanical removal of a stain—due to the effective mechanical removal of any stains by means of the disclosed application device and the residue free treatment by the chemical compositions used. Also, an additional step such as a drying in a tumble dryer step is not needed, since the compositions disclosed herein promote quick drying and the applicators disclosed herein allow application to small areas. The compositions disclosed herein have also been found to leave no visible residues on a fabric even in absence of post-treatment steps.

A fabric is herein referred to as not comprising visible residues, if the fabric receives a rating of less than 2.5 panel score units in the Residue Test Method described below. Preferred methods according to the present invention afford a rating of less than 1.5, more preferably less than 1.0, yet more preferably less than 0.5 panel score units.

Preferred Compositions

Any fabric treatment composition comprising bleach within the scope of the present invention. Preferred are compositions leaving low residues. Particularly preferred composition are stain removal compositions and bleaching compositions described below.

It has been found that bleaches are efficient in fabric treatment, namely stain removal, without leaving visible residues when used according to the present invention. For example, a stain removal composition comprising bleach, may comprise no other or a lesser amount of other fabric treatment components, such as surfactants, which may have a higher tendency to leave visible residues.

Stain Removal Compositions

One problem associated with known fabric treatment compositions hereinafter referred to as stain removal compositions is their tendency to leave visible residues on fabric surfaces. Such residues are problematic and are preferably to be avoided herein since the present process does not involve conventional immersion or rinse steps. Accordingly, the stain removal compositions herein should, most preferably, be substantially free of various polyacrylate-based emulsifiers, polymeric anti-static agents, inorganic builder salts and other residue-forming materials, except at low levels of 0.1%-0.3%, and preferably 0%, of the final compositions (%, as used herein, denotes % by weight of 100% active). Water used in the compositions should preferably be distilled, deionized or otherwise rendered free of residue-forming materials.

Accordingly, in a preferred aspect of this invention there are provided stain removal compositions which are substantially free of materials which leave visible residues on the treated fabrics. This necessarily means that the preferred stain removal compositions are formulated to contain a high level of volatile materials, preferably water, preferably 95%, a cleaning solvent such as BPP at a low, but effective, level, typically 1% to 4%, preferably 2%, hydrogen peroxide at a level from 1% to 3%, preferably 2%, and surfactant at levels of 0.1% to 1%.

Advantageously, when thus formulated such compositions exist as phase-stable aqueous solutions rather than as suspensions or emulsions. Thus, such compositions do not require use of additional emulsifiers, thickening agents, suspending agents, and the like, all of which can contribute to the formation of undesirable visible residues on the fabric.

Indeed, as an overall proposition, the chemical compositions which are used to provide the stain removal and the overall cleaning and/or refreshment functions herein comprise ingredients which are safe and effective for their intended use, and, as noted above, do not leave unacceptable amounts of visible residues on the fabrics. While conventional laundry detergents are typically formulated to provide good cleaning on cotton and cotton/polyester blend fabrics, the compositions herein must be formulated to also safely and effectively clean and refresh fabrics such as wool, silk, rayon, rayon acetate, and the like. In addition, the compositions herein comprise ingredients which are specially selected and formulated to minimize dye removal or migration from the stain site of fugitive, unfixed dye from the fabrics being cleaned. The preferred compositions herein are formulated to minimize or avoid these problems.

The dye removal attributes of the present compositions can be compared with art-disclosed cleaners using photographic or photometric measurements, or by means of a simple, but effective, visual grading test, the dye removal test described below.

In addition to the foregoing considerations, the compositions used herein are preferably formulated such that they are easily dispensed and not so viscous or self-adhesive in nature that they render the stain removal applicator unhandy or difficult to use. Preferably the fabric treatment compositions described herein are formulated as liquid fabric treatment compositions. In one alternative they may be provided as a gel. A stain removal composition according to the present invention comprises:

(a) Bleach—The compositions herein comprise from 0.0001% to 99.99%, preferably 0.01% to 10%, more preferably 0.1% to 7%, by weight, of bleach, preferably peroxide bleach, most preferably hydrogen peroxide. More preferred spot cleaners will comprise 0.5% to 3% hydrogen peroxide. It will be appreciated that peroxide sources other than $H_2O_2$ can be used herein. Thus, various per-acids, per-salts, per-bleaches and the like known from the detergency art can be used. However, such materials are expensive, difficult to formulate in liquid products, can leave residues on fabrics and offer no special advantages over $H_2O_2$ when used in the present manner.

(b) Surfactant—The compositions herein comprise from 0% to 99.99%, preferably 0.05% to 5%, more preferably 0.05% to 2% by weight of surfactants, such as ethoxylated alcohols or alkyl phenols, alkyl sulfates, NaAES, NH4AES, amine oxides, and mixtures thereof. As noted above, use of surfactants limited to the lower end of the range is preferred for some dyes and fabric types. Typically, the weight ratio of BPP solvent:surfactant(s) is in the range of from about 10:1 to about 1:1. One preferred composition comprises 2% BPP/0.8% AES. Also, nonionics such as the ethoxylated C10-C16 alcohols, e.g., NEODOL 23-6.5, can be used in the compositions. The alkyl sulfate surfactants which may be used herein as cleaners and to stabilize aqueous compositions are the C8-C18 primary ("AS"; preferred C10-C14, sodium salts), as well as branched-chain and random C10-C20 alkyl sulfates, and C10-C18 secondary (2,3) alkyl sulfates of the formula CH3(CH2)x(CHOSO3-M+) CH3 and CH3 (CH2)y(CHOSO3-M+) CH2CH3 where x and (y+1) are integers of at least 7, preferably at least 9, and M is a water-solubilizing cation, especially sodium, as well as unsaturated sulfates such as oleyl sulfate. Alkyl ethoxy sulfate (AES) surfactants used herein are conventionally depicted as having the formula R(EO) xSO3Z, wherein R is C10-C16 alkyl, EO is —CH2CH2-O—, x is 1-10 and can include mixtures which are conventionally reported as averages, e.g., (EO)2.5, (EO) 6.5 and the like, and Z is a cation such as sodium ammonium or magnesium (MgAES). The C12-C16 alkyl dimethyl amine oxide surfactants can also be used.

(c) Solvent—The compositions herein may comprise from 0% to 99.99% preferably from 0% to 10% by weight, of butoxy propoxy propanol (BPP) solvent or other solvents as described herein. Organic solvents are preferred for use in the present compositions. Preferred spot cleaners will comprise 1-4% BPP which is available in commercial quantities as a mixture of isomers in about equal amounts. The isomers, and mixtures thereof, are useful herein. The isomer structures are as follows:

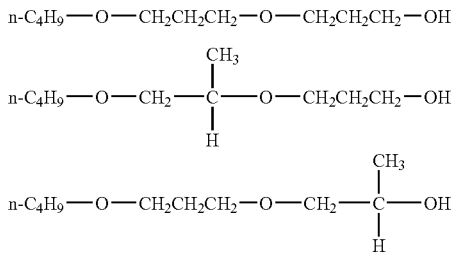

Other useful solvents are hydrotropes such as sodium toluene sulfonate and sodium cumene sulfonate, short-chain alcohols such as ethanol and isopropanol, and the like. They can be present in the compositions as only solvents or in combination with other solvents.

(d) Water—The preferred, low residue compositions herein may comprise from 0% to 99.99%, preferably from 70% to 99.99%, more preferably 90% to 99.9%, most preferably from 94.0% to 99.0%, by weight, of water and hence are preferably aqueous solutions. Water used in the compositions should preferably be distilled, deionized or otherwise rendered free of residue-forming materials.

(e) Other Optionals—The compositions herein may comprise minor amounts of various optional ingredients, including enzymes, preservatives, anti-static agents, fragrances, odor absorbing components, and the like. If used, such optional ingredients will typically comprise from 0.0001% to 10%, more preferably from 0.01% to 2%, by weight, of the compositions, having due regard for residues on the cleaned fabrics. Preferred optionals are namely the following:

Chelator—The chelating agent is selected from those which, themselves, are stable in aqueous $H_2O_2$ and which stabilize the $H_2O_2$ by chelating vagrant metal ions. Such chelating agents are typically already present at low, peroxide-stabilizing amounts (0.01%-1%) in commercial sources of hydrogen peroxide.

Enzymes—Besides the optional surfactants in the stain removal compositions herein can contain enzymes to further enhance cleaning performance. Lipases, amylases and protease enzymes, or mixtures thereof, can be used. If used, such enzymes will typically comprise from 0.001% to 5%, preferably from 0.01% to 1%, by weight, of the composition. Commercial detersive enzymes such as LIPOLASE, ESPERASE, ALCALASE, SAVINASE and TERMAMYL (all ex. NOVO) and MAXATASE and RAPIDASE (ex. International Bio-Synthesis, Inc.) can be used.

Preservatives—The compositions herein can optionally be preserved for storage using conventional preservatives such as KATHON® at a level of 0.0001%-1%, by weight.

Anti-static agents—If an antistatic benefit is desired, the compositions used herein can contain an anti-static agent. If used, such anti-static agents will typically comprise at least 0.5%, typically from 2% to 8%, by weight, of the compositions. Preferred anti-stats include the series of sulfonated polymers available as VERSAFLEX 157, 207, 1001, 2004 and 7000, from National Starch and Chemical Company Fragrances—The odor absorbing composition of the present invention can also optionally provide a "scent signal" in the form of a pleasant odor which signals the removal of malodor from fabrics. The scent signal is designed to provide a fleeting perfume scent, and is not designed to be overwhelming or to be used as an odor masking ingredient. When perfume is added as a scent signal, it is added only at very low levels, e.g., from 0% to 0.5%, preferably from 0.003% to 0.3%, more preferably from 0.005% to 0.2%, by weight of the usage composition.

Perfume can also be added as a more intense odor in product and on surfaces. When stronger levels of perfume are preferred, relatively higher levels of perfume can be added. Any type of perfume can be incorporated into the composition of the present invention.

Odor absorbing components—The compositions of the present invention may further comprise an optional cyclodextrin. This will impart the composition with odour absorbing properties, which is especially useful for application on inanimate surfaces to control the malodour.

As used herein, the term "cyclodextrin" includes any of the known cyclodextrins such as unsubstituted cyclodextrins containing from six to twelve glucose units, especially, alpha-cyclodextrin, beta-cyclodextrin, gamma-cyclodextrin and/or their derivatives and/or mixtures thereof. The preferred cyclodextrins are available, e.g., from Cerestar USA, Inc. and Wacker Chemicals (USA), Inc.

Typical levels of cyclodextrin in usage compositions for usage conditions are from 0.01% to 5%, preferably from 0.1% to 4%, more preferably from 0.2% to 2% by weight of the composition.

The preselected pH range of the stain removal compositions assists in stabilising the hydrogen peroxide present and is typically in the acid-slightly basic range from about 3 to about 8, preferably about 6.

A stain removal composition comprising water, surfactant and bleach is efficient in treating a large variety of stains. It is known that various greasy stains are best treated with a surfactant whereas other common stains such as from grass, tomato sauce or wine are best treated with bleach, while water soluble stains can normally effectively removed with water.

While referring to stain removal compositions, the compositions disclosed herein may also favourably be used in other contexts, for example for bleaching and/or sanitation of non-stained fabrics.

Examples of Stain Removal Compositions

Having due regard to the foregoing considerations, the following illustrates preferred examples of stain removal compositions, but is not intended to be limiting thereof.

EXAMPLE 1

| | % (wt) of 100% active component formula range |
|---|---|
| BPP | 1.0-2.0 |
| Hydrogen peroxide | 1.5-3.0 |
| Alkyl sulfate surfactant | 0.3-1.0 |
| Perfume | 0.005-0.01 |
| Ethanol | 0.3-1.0 |
| EDTA | <0.01 |
| Water | Balance |

EXAMPLE 2

| | % (wt) of 100% active component formula range |
|---|---|
| BPP | 1.0-2.0 |
| Hydrogen peroxide | 1.5-3.0 |
| LIPOLASE | 0.3-0.5 |
| Alkyl sulfate surfactant | 0.3-1.0 |
| Perfume | 0.005-0.01 |
| Ethanol | 0.3-1.0 |
| EDTA | <0.01 |
| Water | Balance |

Bleaching Compositions

Another example of a preferred composition according to the present invention is a bleaching composition.

A preferred bleaching composition comprises hydrogen peroxide, water, and may in addition comprise other components such as fragrance and solvents as described herein above. Preferred levels in % by weight of 100% active component for these components are given in the Example below:

| | % (wt) of 100% active component formula range |
|---|---|
| Hydrogen peroxide | 1.5-3.0 |
| BPP | 1.0-2.0 |
| Perfume | 0.005-0.01 |
| Ethanol | 0.3-1.0 |
| EDTA | <0.01 |
| Water | Balance |

A bleaching composition as disclosed herein may be used for stain removal. A bleaching composition is most effective for stain removal on bleachable stains, e.g. wine, tomato sauce, blood stains. In particular bleaching compositions as disclosed herein may also favourably be used in other contexts, for example for bleaching and/or sanitation of non-stained fabrics.

Preferred Applicators

Generally all convenient to carry applicators are within the scope of the present invention. The choice of a particular applicator will largely depend on the usage envisaged. For example a wipe or a towelette applicator may be chosen. Such wipes or towelettes may be packaged individually or a plurality of them may be packaged together. Preferably such packaging prevents evaporation of the compositions disclosed herein.

Other preferred applicators are those comprising a nib. Such applicators typically also comprise a housing comprising a reservoir for the storage of a composition. Such a housing may be a bottle of any shape or size. Preferred shapes for such housings are hollow barrel shapes, most preferably having a diameter to length ratio from 1:30 to 1:2, so as to be convenient to hold in the user's hand, use and store. More preferred are housings of a diameter to length ratio from 1:20 to 1:5, which resemble in shape a pen, e.g. a ball pen or a highlighter pen, and which are herein referred to as pen-shaped. The reservoir may be filled with an absorbent material, such as a wadding or a cartridge style device such as those commonly found in ink pens able to release liquid on demand. The housing may be made of any solid material, which may also be flexible, such as glass or any plastic material. A preferred material is polypropylene.

The housing may have one or more application devices. An application device, as used herein, is a device which in use is in contact with the surface on which the fabric treatment applicator is used and delivers the fabric treatment composition to that surface. One preferred application device according to the present invention is a nib. Other preferred application devices include any felt, non-woven material, sponge, or foam insert, for example in the form of a porous pad. Another preferred application device is a roller ball. Applicators comprising no other application device but a nib are preferred.

Such a nib typically is a fibre-tip nib as commonly found in children's colouring pens or highlighting pens. Preferably the nib is cone-shaped or wedge-shaped. A cone or wedge shaped nib allows the exertion of pressure on a relatively narrow area, which is beneficial for mechanical stain removal, without leading to damage of the nib, which is thicker and hence more stable closer to the housing. A cone or wedge shaped nib also allows the application of the fabric treatment composition to a small selected area which is beneficial for low moistening of the fabric and low residues.

The application device should further be in contact with the reservoir directly or indirectly so as to allow transfer of the fabric treatment composition to the application device during use. The nib may be made of any synthetic or man-made or natural materials such as felt, open cell foam, closed cell foams, polyethylene, nylon etc. A preferred material for the nib is felt. Another preferred material for the nib are synthetic fibres. The nib may have any shape, cone style or 'wedge shape' being preferred for the nib. The nib while held by the housing has a section external to the housing, this section preferably measures from 3.0 cm to 0.1 cm, more preferably from 1.0 cm to 0.25 cm, most preferably from 0.75 cm to 0.5 cm in length.

The contact area—measured as given below—between the application device and a flat surface preferably is from 0.25 $mm^2$ to 400 $mm^2$, more preferably from 1 $mm^2$ to 100 $mm^2$, most preferably from 4 $mm^2$ to 10 $mm^2$. Such a contact area ensures optimal mechanical stain removal and allows for application of the fabric treatment composition to small selected areas.

Preferred application devices according to the present invention also exhibit a certain delivery volume efficiency—measured as described below. The delivery volume efficiency is defined as the amount of fluid (ml) delivered to the fabric per unit time per unit area ($s^{-1}mm^{-2}$). The right delivery volume efficiency ensures that a sufficient but not too high amount of fabric treatment composition is delivered giving the benefits of a sufficient and constant flow rate and further the benefit of avoiding drying out of the nib (10) or the reservoir in between uses. The delivery volume efficiency is preferably from 0.0005 ml $mm^{-2}$ $s^{-1}$ to 0.1 ml $mm^{-2}$ $s^{-1}$ and more preferably from 0.001 ml $mm^{-2}$ $s^{-1}$ to 0.01 ml $mm^{-2}$ $s^{-1}$.

The applicator may also comprise a cap to prevent evaporation of the composition and to prevent any unattended contact of the application device with objects when not used.

TEST METHODS

Dye Removal Test

An expert panel assists in visual grading. Thus, in one such test, swatches of fabric are individually dyed with a dye from a representative dye category such as from reactive dyes, sulphur dyes, vat dyes, direct dyes and azoic dyes. A swatch of fabric is prepared with a dye from each category. A measured area within each swatch is treated with the fabric treatment composition and allowed to dry. Any dye removal in the treated swatch is assessed visually by comparing the treated area of the swatch with the surrounding untreated area of the swatch. Numerical units ranging from : (0) 'no difference between both fabrics', (1) 'I think there is a difference', (2) 'I'm sure there is a difference', (3) 'there is a big difference', (4) 'there is a huge difference' are assigned by panelists. The test is repeated three times of any swatch and an average value is calculated.

Measurement of Contact Area

Measurements of the contact area of the application device are carried out with a fabric treatment applicator which contains a dry application device and no treatment composition. The dry application device is inked by pressing it against an ink stamp pad and then clamping the fabric treatment applicator to the load arm of a Plint dual axis reciprocating rig (such as model TE75R, MRPRA RUBBER CONSULTANTS). A mark on a contact surface which is representative of the contact area of the application device is obtained by controlled lowering and raising of the Plint load arm towards and away from the contact surface. The angle of the fabric treatment applicator relative to the contact surface is adapted to maximise the contact area. Angles of the fabric treatment applicator relative to the contact surface for which the angle between the vertical axis of the fabric treatment applicator (as defined above) and the contact surface less than 45° are not considered (since they are not typical for a consumer preferred application method). The contact time should be approximately 1 s while a 3 N load should be applied on the application device. The contact area can then be calculated from the mean length and width of the mark determined using a magnifying lens with a graticule. Measurements with the application device in final measuring position are repeated three times to check reproducibility.

Measurement of Delivery Volume Efficiency

The application device is firmly inserted through the bottom of a standard liquid container (such as a 50 ml centrifuge tube available from Corning No. 25330-50). To ensure a secure arrangement, the size of the orifice through which the application device is inserted is cut to the size of the application device and a silicone based sealant used. This unit is then clamped into position beneath a compressor unit (such as a Lloyd LR5K Compression meter). This arrangement provides a consumer realistic vertical load of 3 N. The application device is placed in contact with an absorbent pad comprised of a bicomponent synthetic fibre top layer above a fluffy pulp base layer. The pad allows rapid transport away from the point of delivery so as not to reduce the concentration gradient and hence reduce flow. The container is then filled with the stain removing solution (such as Example 1) to a level of 20 ml. The amount of fluid that flows per unit time is measured by noting the loss of fluid from the reservoir over a fixed period. The delivery volume efficiency is then calculated by normalising the flow rate with respect to the total surface area of contact ($mm^2$) between the application device and the fabric. Measurements are repeated three times to check reproducibility.

Residues Test Method

The tendency of a composition to leave visible residues (rings and the like) on fabrics which require rinsing or another post treatment step can be assessed by a simple but effective visual grading test. An expert panel assists in the visual assessment. A swatch of blue 100% cotton shirt fabric is prepared and a drop of a composition as specified in Example 1 applied to the fabric and allowed to dry. The treated area is then graded visually for the presence of any visible residue by comparing the treated area of the swatch with the untreated area of the swatch. Numerical units, herein referred to a panel score units, are assigned by panellists as follows: (0) 'No difference between the treated area and untreated area, (1) 'I think there is a difference between the treated area and untreated area, (2) 'I'm sure there is a difference between treated area and untreated area, (3) 'There is a big difference between the treated and the untreated area, (4) 'There is a huge difference between the treated area and the untreated area'.

What is claimed is:

1. A method for treatment of a fabric away from home by a convenient to carry fabric treatment applicator containing a composition therein, said composition comprising:

a) from 1% to 3% of hydrogen peroxide;

b) from 1% to 4% of a cleaning solvent;

c) water;

d) from 0.1% to 1% surfactant; and e) cyclodextrin;

wherein said composition is free from residue-forming materials selected from emulsifiers, thickening agents, and suspending agents; said method comprising the application of said composition to said fabric by use of the applicator, wherein said composition after said application to said fabric is left to evaporate, said fabric after evaporation of said composition has a score of less than 1.5 according to the Residue Test Method and said method is performed away from home, and wherein said fabric is maintained at ambient temperature after said application of said composition.

2. A method according to claim 1 wherein said method is performed at work, in a restaurant or when traveling.

3. A method for treatment of a fabric by a convenient to carry fabric treatment applicator containing a composition therein, said composition comprising:

a) from 0.01% to 10%, by weight, of hydrogen peroxide;

b) from 0% to 10%, by weight of butoxy propoxy propanol solvent;

c) from 70%, by weight, water; and d) cyclodextrin; wherein said composition is free from residue-forming materials selected from emulsifiers, thickening agents, and suspending agents; said method comprising the application of said composition to said fabric by use of the applicator such that said applicator rubs said composition across said fabric to treat said fabric to remove a stain, wherein said composition after said application to said fabric is left to evaporate, said fabric after evaporation of said composition has a score of less than 1.5 according to the Residue Test Method, and wherein said fabric is maintained at ambient temperature after said application of said composition, and wherein the applicator comprises a nib and a housing in fluid communication with said nib, wherein said housing is a barrel shape having a diameter to length ratio from 1:30 to 1:2.

4. A method according to claim 3 wherein the diameter to length ratio is from 1:20 to 1:5.

5. A method according to claim 3, wherein said method occurs in a single step.

6. A method according to claim 1 wherein said fabric is maintained at ambient temperature after said application of said composition.

7. A method according to claim 1 wherein said fabric is worn on the human body after said application of said composition.

8. A method according to claim 1 wherein said fabric after evaporation of said composition has a score of less than 1.0 according to the Residue Test Method.

9. A method according to claim 1 wherein said applicator has a contact area from 0.25 $mm^2$ to 400 $mm^2$.

10. A method according to claim 1 wherein said applicator has a delivery volume efficiency from 0.005 ml $mm_{-2}s^{-1}$ to 0.1 ml $mm^{-2}s^{-1}$.

11. A method according to claim 1 wherein the composition comprises at least 95% water.

12. A method according to claim 1 wherein the applicator comprises a housing having a diameter to length ratio of from 1:20 to 1:5.

13. A method according to claim 1, wherein said method occurs in a single step.

* * * * *